US006502913B2

(12) United States Patent
Ho et al.

(10) Patent No.: US 6,502,913 B2
(45) Date of Patent: Jan. 7, 2003

(54) INK-JET OUTPUT CONTROL METHOD

(75) Inventors: Chien-Hsien Ho, Yilan (TW); Chia-Lei Yu, Taoyuan (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/940,677

(22) Filed: Aug. 29, 2001

(65) Prior Publication Data

US 2002/0039121 A1 Apr. 4, 2002

(30) Foreign Application Priority Data

Oct. 4, 2000 (TW) ..... 89120708 A

(51) Int. Cl.[7] ..... B41J 29/38; B41J 23/00
(52) U.S. Cl. ..... 347/9; 347/37
(58) Field of Search ..... 347/9, 37; 400/279

(56) References Cited

U.S. PATENT DOCUMENTS 3,942,619 A * 3/1976 Nordstrom et al. ..... 400/322
4,524,364 A * 6/1985 Bain et al. ..... 347/39
5,189,436 A * 2/1993 Yoshikawa ..... 347/37

* cited by examiner

*Primary Examiner*—John Barlow
*Assistant Examiner*—Alfred E. Dudding
(74) *Attorney, Agent, or Firm*—Rabin & Berdo, P.C.

(57) ABSTRACT

An ink-jet output control method used to control the printing quality of ink-jet output device achieving an even distribution of ink dots is provided, wherein the ink-jet output device, being driven by a step motor, is a printhead carriage on which a printhead is mounted. The ink-jet output control method includes: firstly, to set a number of time pulse values of every two adjacent ink dots in each step of the step motor under different velocity models; then, store these set values which are non-identical in a memory unit; next, the printhead determines the time interval of ink-jet signal sending according to these set time pulse values; lastly, the printhead spreads ink dots on a recording medium with unequal time interval interpolation on receiving ink-jet control signals, such that ink dots are well distributed, an even interpolation and better printing resolution can be achieved.

20 Claims, 3 Drawing Sheets

INK-JET OUTPUT CONTROL METHOD

This application incorporates by reference Taiwanese application Serial No. 89120708, filed Oct. 4, 2000.

BACKGROUND OF THE INVENTION

1. Field of the Invention

The invention relates in general to an ink-jet output control method, and more particularly to a control method for an ink-jet output device using a step motor.

2. Description of the Related Art

The step motor and servo motor are the two most popular types of motor used in image positioning control for ink-jet output devices such as printers, facsimiles and multi-function machines. Since the servo motor is too expensive, most low-priced ink-jet output devices use the step motor as the source of power for the reciprocating movement of the printhead carriage. The step motor adopts an open loop control system whereby the printhead carriage's velocity of movement during printing is controlled. The advantages of the step motor include low price, easy control and less time error during operation. As the ink-jet printhead is mounted on the print-head carriage, the printhead will proceed a reciprocating movement to facilitate printing when the carriage is driven by the step motor.

Step motors, whose driving method includes full-step, half-step and micro-step, are further categorized as two-phase, three-phase, four-phase and five-phase step motors. The micro-step driving method can provide a higher position resolution. However, the ordinary step motor installed in an ink-jet output device to drive the printhead carriage still fails to produce adequate mechanic resolution despite the application of the micro-step motor. In order to improve printing resolution, interpolation is implemented in every step to improve the distribution of ink dots.

Please refer to FIG. 1, which is a graph showing the relationship between the stepping motor velocity ω and the time T. As shown in FIG. 1, from a macro view, the motor proceeds with a constant angular acceleration 102 movement from a still state, carries out constant speed printing with a constant angular velocity 104 movement and returns to the still state after a constant angular deceleration 106. The time interval in each step is larger during low speed than in high speed. For example, the time interval in a second step 108, Δt2, is larger than the time interval in an $n^{th}$ step 110, Δtn.

From a micro view, the motor experiences a process of acceleration/deceleration during an actual magnetizing operating velocity 112 in each step. That is to say, the motor achieves a maximum angular acceleration 114 in the magnetizing transient and proceeds with the process of angular deceleration after a maximum angular velocity 116 has been reached, and achieves a minimum angular velocity 118 before the next magnetizing occurs. Since the speed of the printhead carriage cannot be controlled in a real constant speed movement, a real even interpolation and quality printing cannot be achieved if the motor adopts an equal time interval interpolation in each step.

SUMMARY OF THE INVENTION

It is therefore an object of the invention to provide an ink-jet output method, according to every velocity change of the motor, which proceeds with an ink-jet interpolation in unequal time intervals to achieve an even distribution of ink dots.

To achieve the above-mentioned object, an ink-jet output control method is provided to control the printing quality of ink-jet output devices, wherein the ink-jet output device includes a printhead, a printhead carriage and a step motor used to drive the printhead carriage under a variety of velocity models. The above-mentioned printhead can jet out a number of ink drops in each step of the step motor. The ink-jet output control method includes: firstly, to set a number of time pulse values of every two adjacent ink dots in each step of the step motor under different velocity models, and store these set values, which are non-identical in a memory unit. Next, the printhead determines the time interval of ink-jet signal sending according to these time pulse values, and ink dots are spread on a recording medium in unequal time intervals as the printhead receives ink-jet control signals.

The foregoing time pulse setting method that controls ink-jet outputting includes the experimental revision method, theoretical deduction method and so on. The experimental revision method is as follows: firstly, proceed with equal time interval interpolation in each step of the step motor's rotation to produce several ink dots with unequal distance intervals. Next, having observed the distances between ink dots, adjust the time pulse values of every two adjacent ink dots to obtain several non-identical time pulse values so that every two adjacent ink dots are approximately of the same distance. Lastly, record and store the time pulse values of the ink dots as pre-stored data in a memory unit.

The foregoing time pulse setting method that controls ink-jet outputting further includes the theoretical deduction method, which is as follows: firstly, proceeding with equal time interval interpolation in each step of the step motor's rotation produces several ink dots of unequal distances. Next, having observed the distances and calculated the time pulse values of every two adjacent ink dots, the distances between ink dots will be approximately equal. Lastly, several non-identical time pulse values will be obtained and used as pre-stored data in a memory unit.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
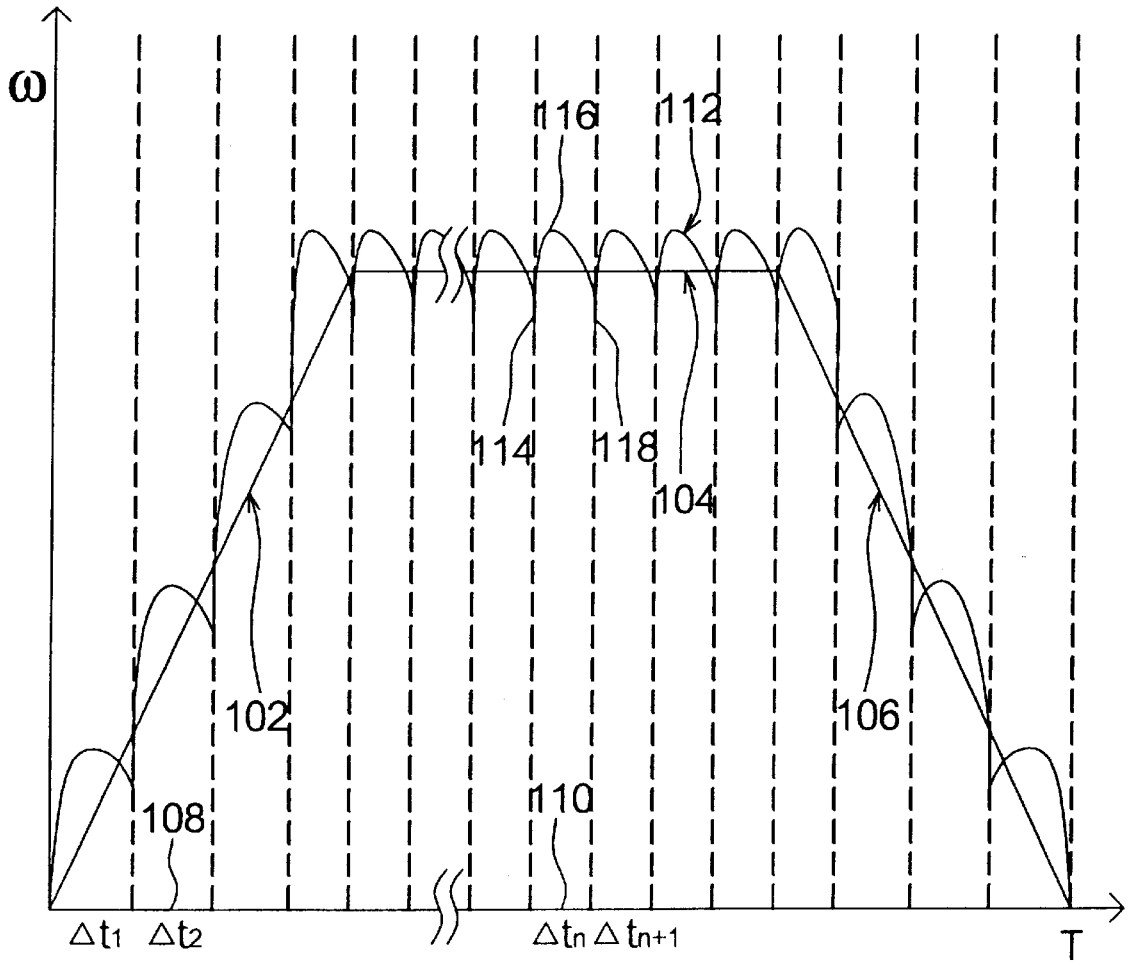
FIG. 1 is a graph showing the relationship between the stepping motor velocity ω and the time T.
Figure 2:
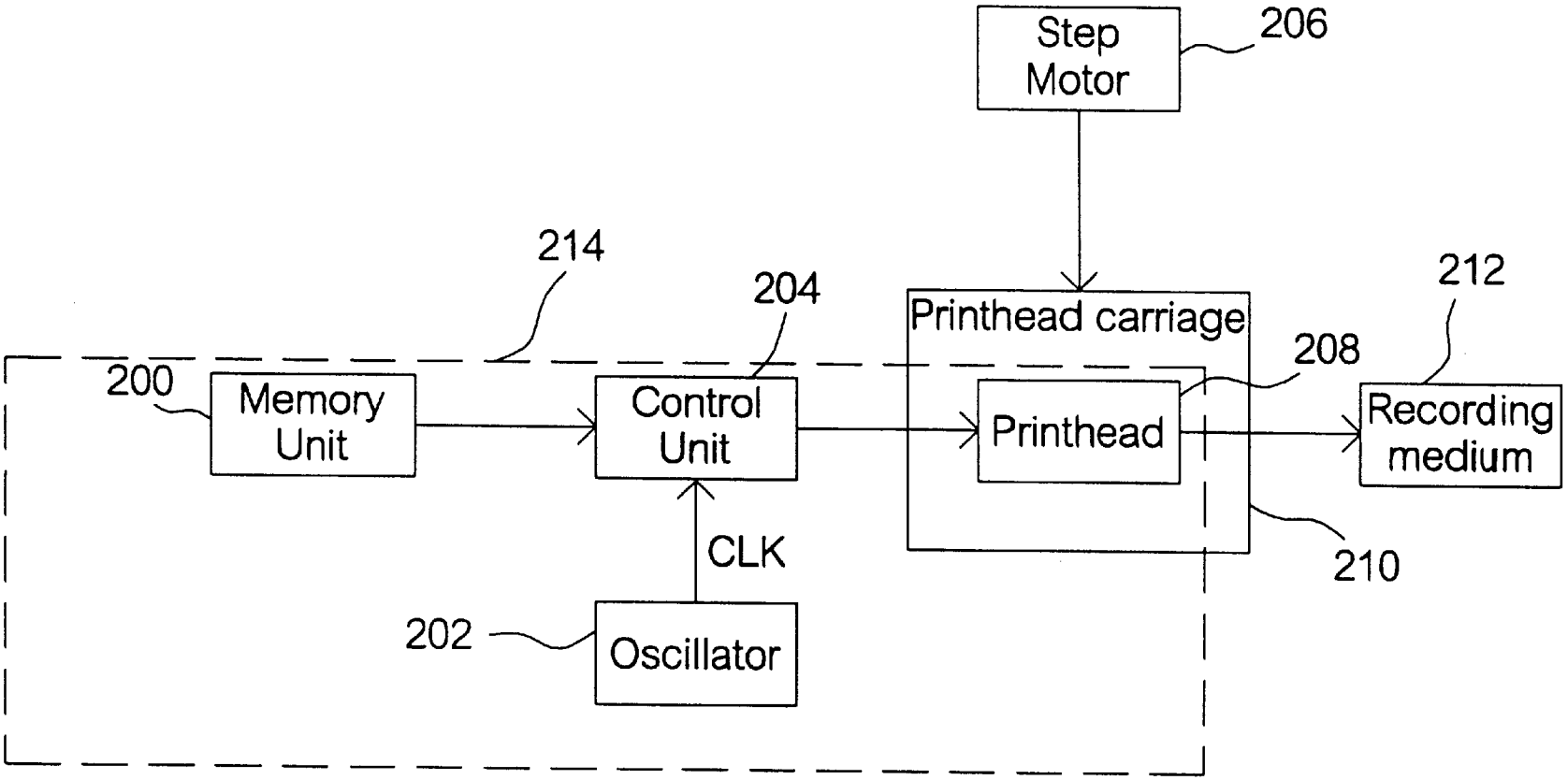
FIG. 2 shows a block diagram of an ink-jet output control device according to a preferred embodiment of the invention.

Please refer to FIG. 2, a block diagram of an ink-jet output control device 214 according to a preferred embodiment of the invention. As shown in FIG. 2, the ink-jet output control device 214 is used to control the printing quality of an ink-jet output device. The ink-jet output device includes a printhead carriage 210 driven and controlled by a step motor 206. The ink-jet output control device 214 includes: a memory unit 200, an oscillator 202, a control unit 204 and a printhead 208, wherein the oscillator 202 generates pulses by means of crystal oscillation and outputs a pulse signal CLK to the control unit 204. The oscillator 202 is an optional device. The oscillator 202 is not the only possible source of pulse signal CLK. Any clock with timing function can serve to provide pulse signal CLK. The control unit 204 receives the pulse signal CLK sent by the oscillator 202; reads the set time pulse values of every two adjacent ink dots in each step stored in the memory unit 200, wherein the set time pulse values of every two adjacent ink dots in each step are non-identical; then transmits the ink-jet output control signal to the printhead 208. When the step motor 206 drives the printhead carriage 210 on which the printhead 208 is mounted, the printhead 208 will proceed with reciprocating movement together with the printhead carriage 210 and spread ink dots on a recording medium 212 respectively according to the set time pulse values. The ink dots are evenly distributed on the recording medium 212 in an equal distance.

Figure 3:
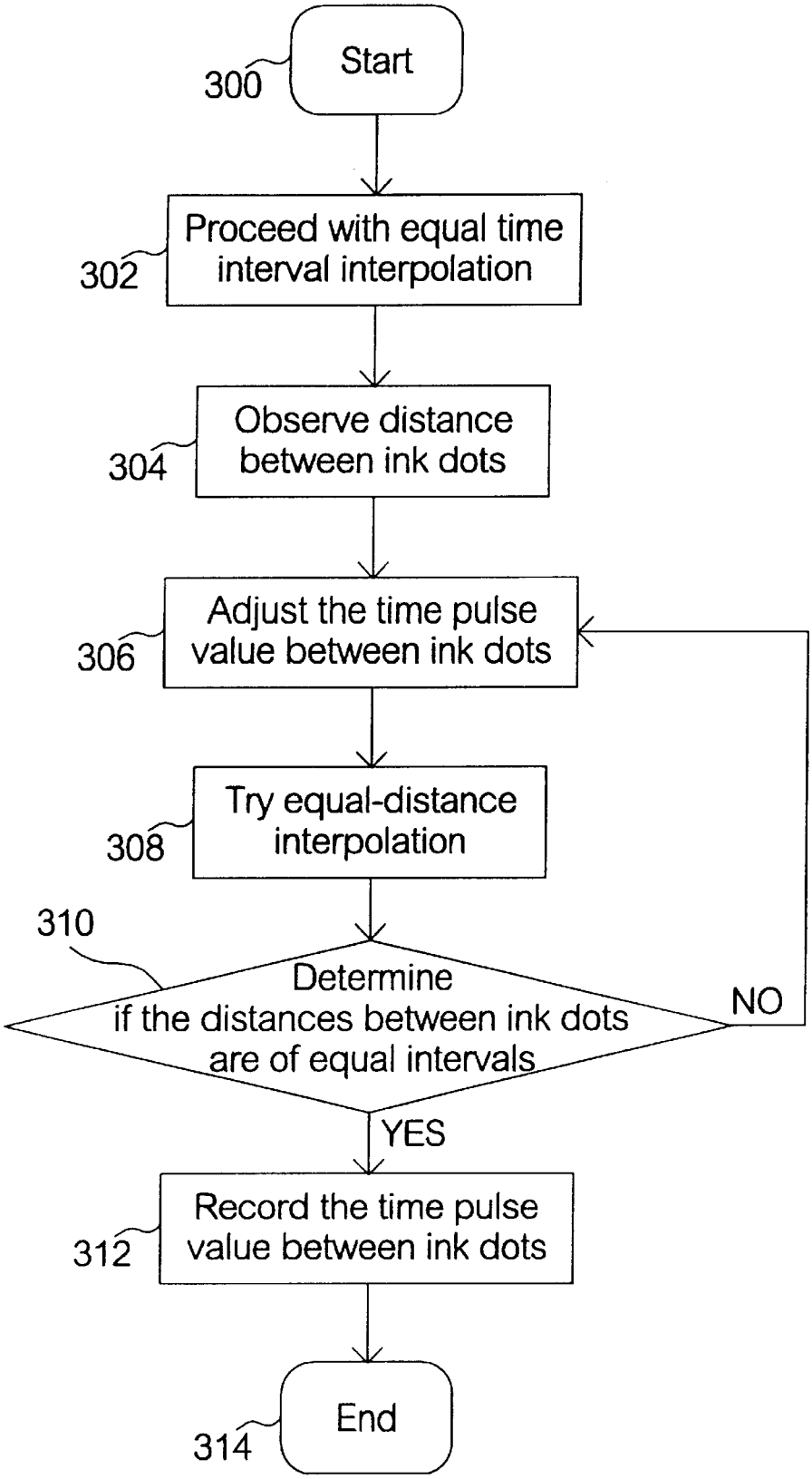
FIG. 3 shows a flowchart of a time pulse setting method that controls ink-jet outputting according to a preferred embodiment of the invention.

Please refer to FIG. 3, which is a flowchart of a time pulse setting method of the ink-jet output control device in FIG. 2 used to control ink-jet outputting. The pulse setting method uses the experimental revision method as an example. However, the example used here is not the only method; other methods like theoretical deduction can also be used. Take the constant speed area of the step motor 206 for example. Let the mechanic resolution of the motor be 75 step/inch, which means the printhead carriage proceeds $1/75$ inch in each step of the step motor 206. When the motor reaches a magnetizing frequency of 1250 Hz in the constant speed area, the printhead proceeds a step every 800 $\mu$s and achieves a velocity of ($1/75$ inch)/(800 $\mu$s)=16.667 inch/sec.

After a procedure 300 is started, interpolation in equal time intervals is performed as shown in a procedure 302. If a 10 MHZ oscillator 202 is used as a reference pulse, the oscillator 202 oscillates 8000 times in each step. When the printing resolution is set to be 600 dpi, 8 ink dots will be jetted out in each step: (600 dots/inch)/(75 step/inch)=8 dots/step. So, in every 1000 oscillations of the oscillator 202, the printhead 208 jets out an ink dot to proceed with equal time interval interpolation. Eight ink dots of different distance intervals are generated in each step.

Next, observe the distances between every two ink dots using a microscope as shown in a procedure 304. From a micro view, the speed in the middle session is always faster than in the beginning and the ending sessions hence resulting in larger distances between ink dots in the middle session than in the beginning and the ending sessions. Following that, adjust the time pulse value of every two adjacent ink dots as shown in a procedure 306. The criterion of the adjust method is that pulse count values in the middle session are smaller than those in the beginning and the ending sessions, which means the time intervals for ink dots in the middle session are smaller than those in the beginning and the ending sessions. By means of simple mathematical calculation or diagram drawing, a number of non-identical time pulse values corresponding to the distances between every two adjacent ink dots can be deducted or estimated, so that the ink dots are approximately of equal intervals.

As shown in a procedure 308, an equal-distance interpolation is tried using the 8 non-identical time pulse values deducted according to the foregoing procedure. Then, as shown in a procedure 310, observe and determine whether the adjusted distances between ink dots are of equal intervals. If the ink dots are of equal intervals, go to a procedure 312 directly; otherwise, return to the procedure 306 and re-adjust the time pulse values of ink dots until the time pulse values corresponding to an even distribution of equal-distance ink dots are obtained.

If the ink dots of the invention jetted out are of equal intervals, which implies that the printhead carriage, which is driven by the step motor 206, proceeds with interpolation using the 8 non-identical deducted time pulse values in the order of n1, n2, n3, n4, n5, n6, n7 and n8 under the velocity of 16.667 inch/sec. In this way, 8 equal-distance ink dots are obtained, wherein n4, n5<n1, n8 and the interval distances between ink dots at the two ends of distribution (n1, n8) are always larger than that distributed in the middle session (n4, n5). Which is to say, the interval distances between ink dots in the same step of the step motor are not identical. In a procedure 312, the time pulse values of ink dots are recorded and pre-stored in the memory unit 200. The time pulse values provide time intervals whereby the control unit 204 directs the printhead 208 to spread ink dots. The end procedure 314 concludes the method.

For any type of the step motor 206, no matter the step motor 206 is operating in the acceleration area, constant speed area or deceleration area, different time intervals of every two adjacent ink dots can be obtained using the foregoing experimental method or theoretical deduction so that ink drops will be more evenly distributed resulting in a better quality of printing.

An ink jet output control method according to the invention is disclosed in the above embodiments. By means of experimental method or theoretical deduction, an unequal time interval interpolation can be applied to the ink jet output device driven by a step motor according to the characteristics and velocity changes of every motor. An even interpolation can be achieved resulting in an even distribution of ink dots and a higher resolution of printing. Thus, the problem of inadequate motor mechanical resolution with which the middle-priced and lower-priced ink-jet output devices are facing can be solved. The printing quality of printers, facsimiles, multi-functional office machines and so on can be improved.

While the invention has been described by way of example and in terms of the preferred embodiment, it is to be understood that the invention is not limited to the disclosed embodiment. Therefore, the scope of protection of the invention is defined in the appended claims; and it is to be understood that the invention is intended to cover various modifications and similar arrangements and procedures, and the scope of the appended claims therefore should be accorded the broadest interpretation so as to encompass all such modifications and similar arrangements and procedures.

What is claimed is:

1. An ink-jet output control method used to control the printing of ink-jet output devices, wherein the ink-jet output device comprises a printhead, a printhead carriage for carrying the printhead and a step motor for driving the printhead carriage under a plurality of velocity models, among which, the printhead jets out a plurality of ink drops in each step of the step motor; the ink-jet output control method comprising the steps of:

(a) setting a plurality of time pulse values of every two adjacent ink dots in each step of the step motor under different velocity models, and storing the time pulse values, which are non-identical, in a memory unit;

(b) the printhead determining the time interval of ink-jet signal sending according to the time pulse values; and (c) spreading ink dots on a recording medium as the printhead receives an ink-jet control signal;

wherein the pulse setting method that controls ink-jet outputting in said step (a) comprises:

(a1) proceeding with equal time interval interpolation in each step of the step motor's rotation to produce a plurality of ink dots of unequal distances;

(a2) observing the distances between the ink dots;

(a3) adjusting the time pulse values of every two adjacent ink dots to obtain a plurality of non-identical time pulse values so that every two adjacent ink dots are approximately of the same distance; and (a4) recording and storing the time pulse values.

2. An ink-jet output control method according to claim 1, wherein the substep (a3) comprises the procedures of:

(a31) adjusting the time pulse value of every two adjacent ink dots;

(a32) proceeding with interpolation according to the time pulse values;

(a33) determining whether the adjusted distances between ink dots are of equal intervals or not; if the ink dots are of unequal intervals, returning to the procedure (a31) until the time pulse values corresponding to an even distribution of equal-distances ink dots are obtained.

3. An ink-jet output control method according to claim 2, wherein the procedure (a31), which regards the method to adjust the time pulse value of every two adjacent ink dots, is achieved by performing mathematical calculation or using diagram drawing to obtain the time pulse values corresponding to ink dots of equal intervals according to the distance between every two adjacent ink dots.

4. An ink-jet output control method according to claim 1, wherein the substep (a1), which regards equal time interval interpolation, has larger distances between ink dots in a middle session than in beginning and ending sessions in a same step of the step motor.

5. An ink-jet output control method according to claim 1, wherein the substep (a4) has smaller time pulse values of every two adjacent ink dots in a middle session than those in beginning and ending sessions in a same step of the step motor.

6. An ink-jet output control method according to claim 1, wherein the ink-jet output device comprises a printer, a facsimile machine or a multi-functional office machine.

7. An ink-jet output control method according to claim 1, wherein the step motor compromises two-phase, three-phase, four-phase and five-phase step motors.

8. An ink-jet output control method according to claim 1, wherein the step motor comprises a full-step drive, a half-step drive or a microstep drive.

9. An ink-jet output control method according to claim 1, wherein the velocity model with which the step motor is equipped comprises the acceleration model.

10. An ink-jet output control method according to claim 1, wherein the velocity model with which the step motor is equipped comprises the deceleration model.

11. An ink-jet output control method used to control printing of an ink-jet output device, wherein the ink-jet output device comprises a printhead, a printhead carriage for carrying the printhead and a step motor for driving the printhead carriage under a plurality of velocity models, among which, the printhead jets out a plurality of ink drops in each step of the step motor; the ink-jet output control method comprising:

obtaining a plurality of set time pulse values by the setting of time intervals between every two adjacent ink dots in each step of the motor so that the set values are non-identical; and the printhead spreading the ink dots on a recording medium according to the set time pulse values, wherein the set value of time pulses is obtained by an experimental method, wherein the experimental method comprises:

proceeding with equal time interval interpolation in each step of the step motor's rotation to produce a plurality of ink dots with unequal distance intervals; and observing the distances between ink dots; and adjusting the time pulse values of every two adjacent ink dots and determining whether the adjusted distances between ink dots are of equal intervals; if the ink dots are of unequal intervals, keeping adjusting the set time pulse values of every two adjacent ink dots until the distance between ink dots are equal so that the corresponding time pulse values are obtained.

12. An ink-jet output control method according to claim 11, wherein the set time pulse values in a middle session of each step of the step motor are smaller than those in beginning and ending sessions.

13. An ink-jet output control method according to claim 12, wherein two time intervals generated by two ink dots which are jetted out in each step of the step motor are unequal.

14. An ink-jet output control method according to claim 11, wherein each step of the step motor is a step in an acceleration mode.

15. An ink-jet output control method according to claim 11, wherein each step of the step motor is a step in an deceleration mode.

16. An ink-jet output control method used to control the printing of ink-jet output devices, wherein the ink-jet output device comprises a printhead, a printhead carriage for carrying the printhead and a step motor for driving the printhead carriage under a plurality of velocity models, among which, the printhead jets out a plurality of ink drops in each step of the step motor; the ink-jet output control method comprising:

obtaining a plurality of set time pulse values by setting time intervals between every two adjacent ink dots in each step of the motor so that the set values are non-identical; and the printhead spreading the ink dots on a recording medium according to the set time pulse values;

wherein the set value of time pulses can be obtained by a theoretical method, wherein the theoretical method comprises:

proceeding with equal time interval interpolation in each step of the step motor's rotation to produce a plurality of ink dots with unequal distance intervals; and recording the interval distances between every two adjacent ink dots; and calculating the set time pulse values of every two adjacent ink dots and determining whether the calculated distances between ink dots are of equal intervals or not so that the corresponding set time pulse values are obtained.

17. An ink-jet output control method according to claim 16, wherein the set time pulse values in a middle session of each step of the step motor are smaller than those in beginning and ending sessions.

18. An ink-jet output control method according to claim 17, wherein two time intervals generated by two ink dots which are jetted out in each step of the step motor are unequal.

19. An ink-jet output control method according to claim 16, wherein each step of the step motor is a step in an acceleration mode.

20. An ink-jet output control method according to claim 16, wherein each step of the step motor is a step in a deceleration mode.

* * * * *